United States Patent [19]

Huey et al.

[11] 4,447,037

[45] May 8, 1984

[54] WELL BLOWOUT PREVENTER, AND PACKING ELEMENT

[75] Inventors: Wai J. Huey, Los Angeles; Fernando Murman, Rancho Palos Verdes; Eugene Matsuda, Laguna Hills, all of Calif.

[73] Assignee: Hydril Company, Los Angeles, Calif.

[21] Appl. No.: 336,691

[22] Filed: Jan. 4, 1982

Related U.S. Application Data

[63] Continuation-in-part of Ser. No. 277,341, Jun. 25, 1981.

[51] Int. Cl.[3] ..... B65D 53/00

[52] U.S. Cl. ..... 251/1 B; 277/73; 277/121; 277/235 R

[58] Field of Search ..... 251/1 B, 1 R; 277/235 R, 73, 121

[56] References Cited

U.S. PATENT DOCUMENTS

| | | | |
|---|---|---|---|
| 2,038,140 | 4/1936 | Stone | 286/16 |
| 2,124,015 | 7/1938 | Stone et al. | 166/15 |
| 2,148,844 | 2/1939 | Stone et al. | 286/26 |
| 2,168,813 | 8/1939 | Vinding | 38/105 |
| 2,287,205 | 6/1942 | Stone | 286/16 |
| 2,609,836 | 9/1952 | Knox | 277/73 |
| 3,225,831 | 12/1965 | Knox | 166/75 |
| 3,323,773 | 6/1967 | Walker | 251/1 |
| 3,486,759 | 12/1969 | Lewis | 277/73 |
| 3,533,468 | 10/1970 | Lewis | 166/5 |
| 3,591,125 | 7/1971 | Lewis | 251/1 B |
| 3,917,293 | 11/1975 | Lewis et al. | 277/114 |
| 3,958,808 | 5/1976 | Lewis | 277/1 |
| 4,098,341 | 7/1978 | Lewis | 166/314 |
| 4,098,516 | 7/1978 | Murman | 277/235 R |
| 4,283,039 | 8/1981 | Schaeper et al. | 251/1 B |

*Primary Examiner*—Martin P. Schwadron
*Assistant Examiner*—Sheri Novack
*Attorney, Agent, or Firm*—William W. Haefliger

[57] ABSTRACT

A well blowout preventer packer unit is characterized by long life, and induced back to front (radial) rubber feeding between metallic inserts to close on well pipe or on a well tool for producing a pressure gradient against the pipe or tool which is greatest at the bottom of the packer extent engaging the pipe, and lowest at the top of the packer extent engaging the pipe. The preventer piston has at least three, and typically four, frusto-conical surfaces to progressively and sequentially penetrate the packer rubber to effect controlled and enhanced rubber displacement for sealing against the pipe or tool.

30 Claims, 20 Drawing Figures

WELL BLOWOUT PREVENTER, AND PACKING ELEMENT

BACKGROUND OF THE INVENTION

This application is a continuation-in-part of our prior application Ser. No. 277,341, filed June 25, 1981 and entitled "WELL BLOWOUT PREVENTER, AND PACKING ELEMENT".

This invention relates generally to well blowout preventers, and more particularly concerns packer units used in such equipment.

For many years, the design of blowout preventer packing units has followed the principles described in U.S. Pat. No. 2,609,836 to Knox. Such units incorporate like metal inserts equally spaced about the packer central axis, and embedded by an elastomeric body. Upon inward constriction of closure of the unit about a well drill pipe, the material is anchored by insert webs as it produces vertical folds stretching radially inwardly to seal against the pipe. In general, the number of folds will equal the number of inserts, and they will be alike in circumferential contour. When the packer unit insert close on itself, with no pipe present, the elastomeric material of the folds advancing toward the axis must at certain times and places stretch or extend as much as 350 to 400%. Repeated closures produce excessive wear and fatigue of the elastomeric or rubber material, reducing the useful life of the packer due to such extreme stretching. Also, the rubber quality must be extremely closely controlled to ensure successful closure and seal-in thousands of pounds per square inch of well fluid pressure. Accordingly, there is a need for a packing unit characterized by significantly reduced rubber stretching, and the useful life of which will be extended over many more closures than conventionally possible.

Another problem with packer design has to do with damage to the rubber that tends to flow or extrude into the spaces between like end-plates on the insert webs, as the plates move relatively inwardly and toward one another during packer constriction.

An improved packer unit is described in U.S. Pat. No. 3,917,293 to Lewis et al. That patent discloses, among other things, the use of alternately different web plates to control packer constriction.

SUMMARY OF THE INVENTION

It is a major object of the invention to provide a packer unit, packer annulus, packer inserts and blowout preventer employing same, all of unusual configuration and improved construction, overcoming the above problems and meeting the described needs.

Basically, the invention contemplates improvements in controlling flow of elastomeric material during packer constriction under application of well pressure; differential closing movement of the packer unit induced by differential compression of the packer material by the closing piston; and reduction in stress levels in the energized rubber or elastomer, during its inward flow, by reduced deformation under pressure. These objectives are achieved, as will appear by providing one or more of the following:

(a) the provision of a packer elastomer annulus having a first body section to be radially inwardly compressed by the piston during the axial advancement while a second body section of the annulus is axially compressed into engagement with inner surface extent of the housing, the two body sections remaining integral;

(b) angularity of the piston and packer cam surfaces aiding the differential compression of the annulus as referred to; the piston having at least three, and typically four frusto-conical surfaces that penetrate the packer element;

(c) the provision of metallic inserts co-acting with the elastomeric material to resist extrusion of elastomeric material relatively upwardly, and induce inward displacement of such material at a relatively low level;

(d) the provision of additional unusually advantageous features of construction, and related to the above.

As a result, the packer unit has long life making it particularly useful for sub-sea and deep well drilling. Back to front (radial) rubber feeding characteristics during closing of the packer facilitate closing on virtually any shape on the drill string, and stripping of tool joints, under pressure, to produce a pressure gradient against the drill pipe which is greatest at the bottom of the packer extent engaging the pipe, and lowest at the top of the packer extent engaging the pipe. Also, less force is required to close the packer than is characteristic of prior packer units of the same size.

These and other objects and advantages of the invention, as well as the details of an illustrative embodiment, will be more fully understood from the following specification and drawings, in which:

DRAWING DESCRIPTION

Figure 6:
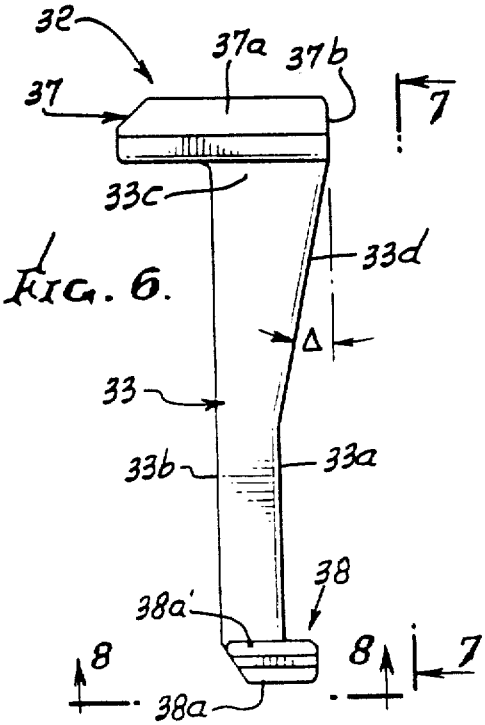
Figure 7:
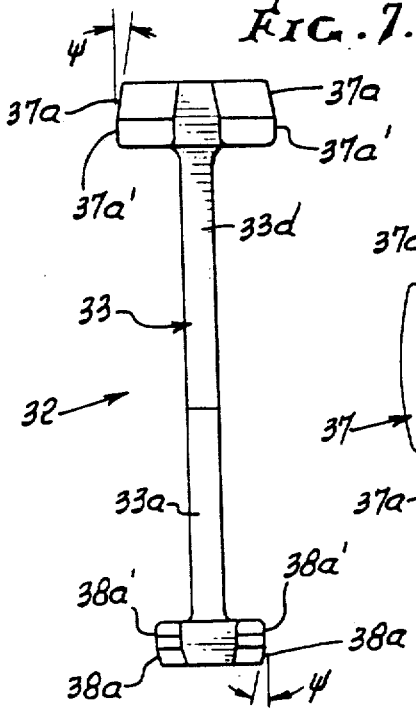
Figure 8:
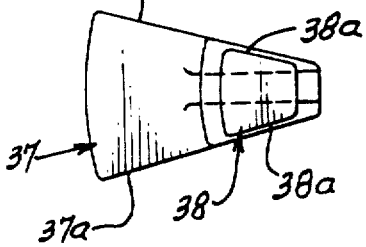
Figure 3:
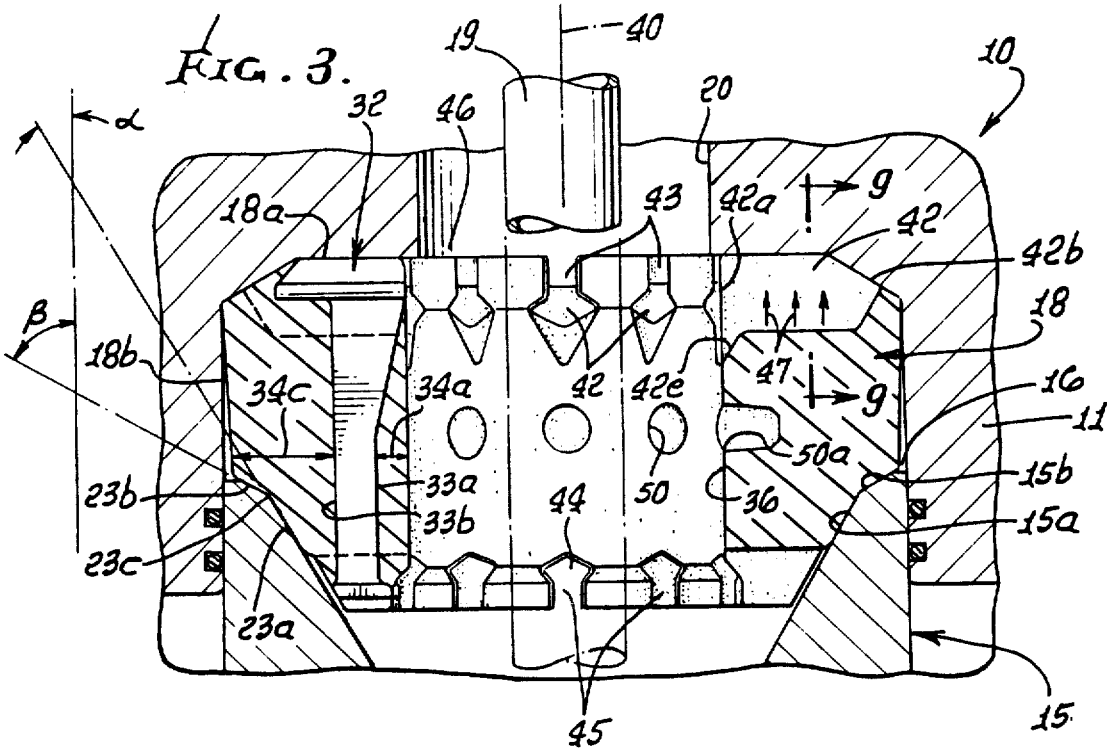
FIG. 3 is an elevation taken in section on lines 3—3 of FIG. 2.
Figure 3A:
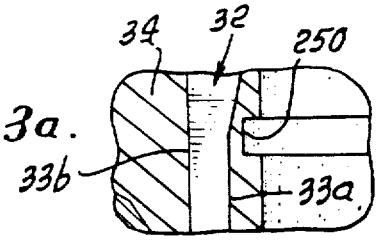
Figure 4:
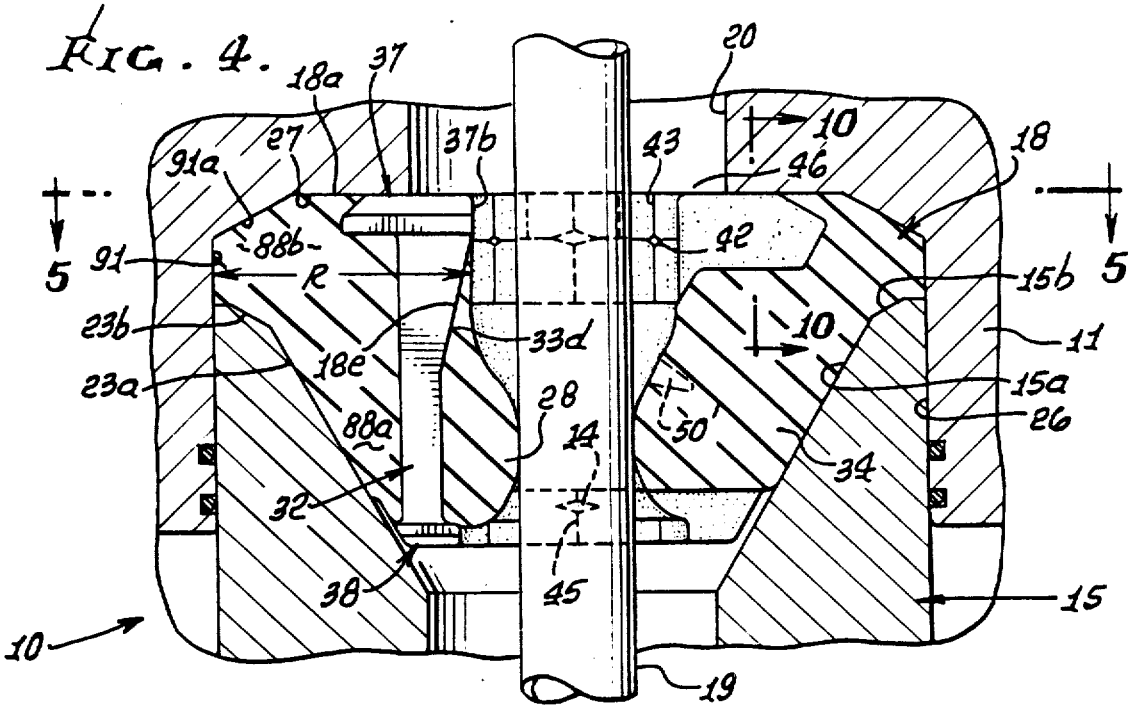
Figure 5:
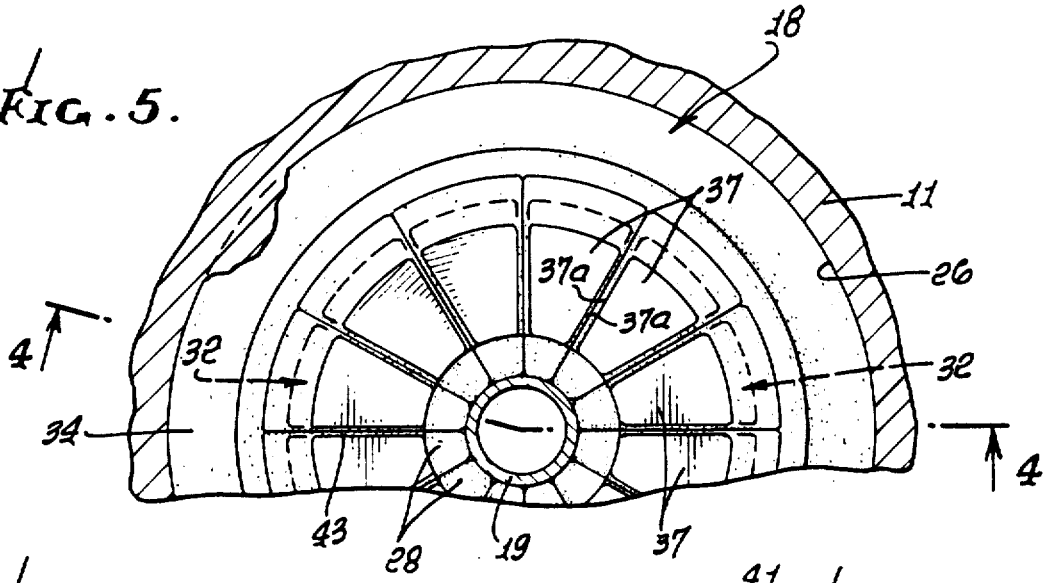
Figure 9:
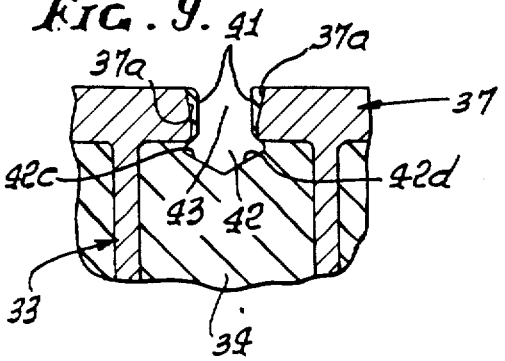
Figure 10:
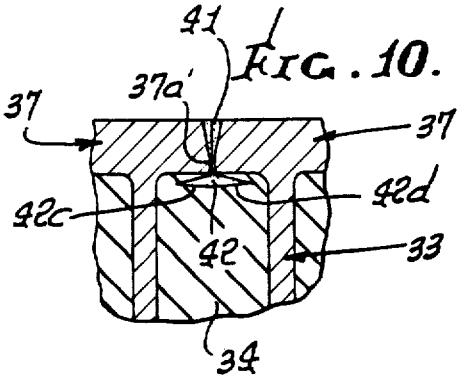
Figure 11:
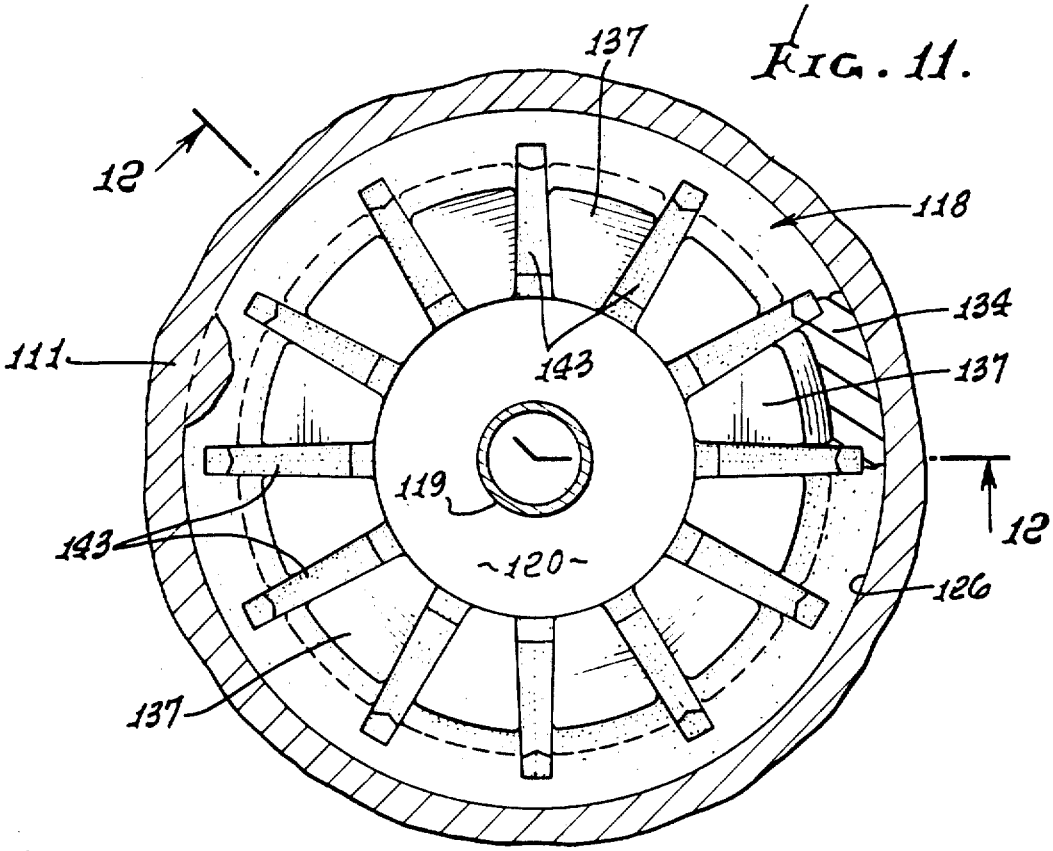
Figure 12:
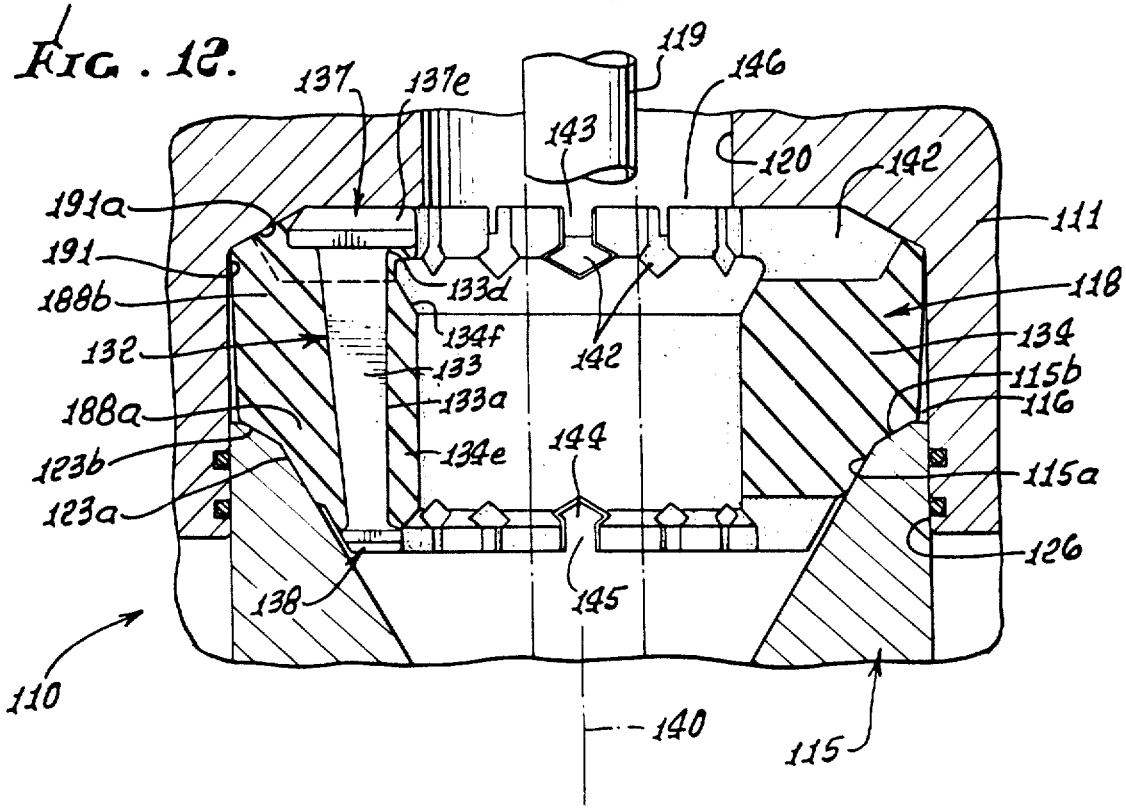
Figure 14:
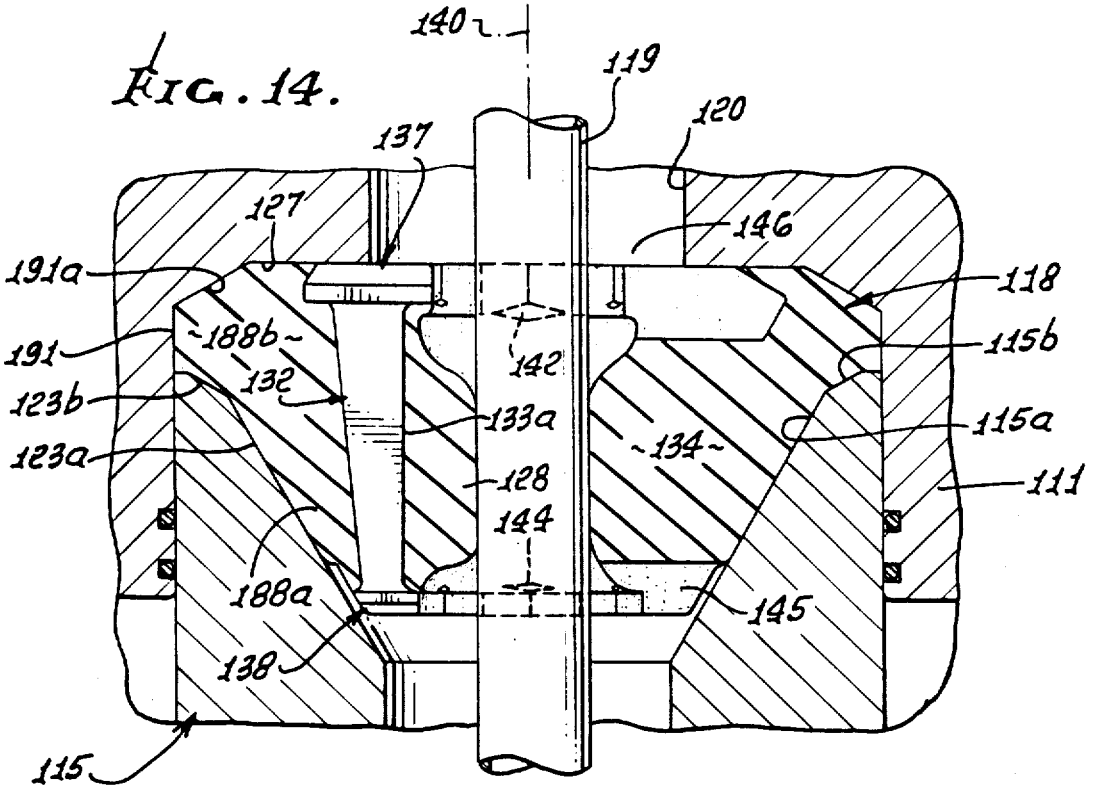
Figure 13:
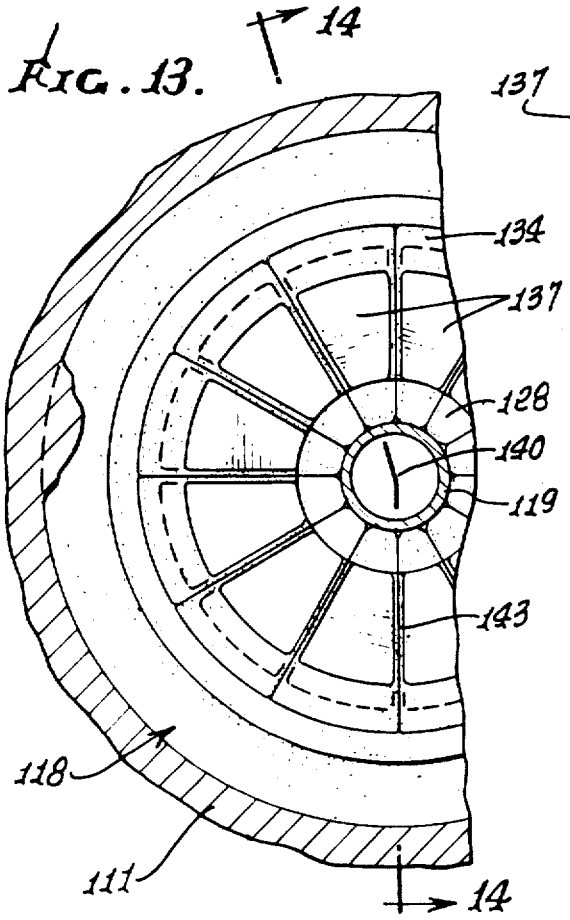
Figure 15:
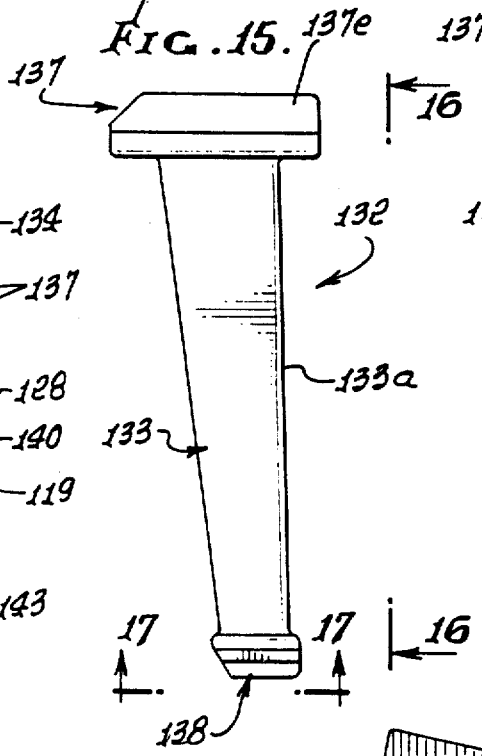
Figure 16:
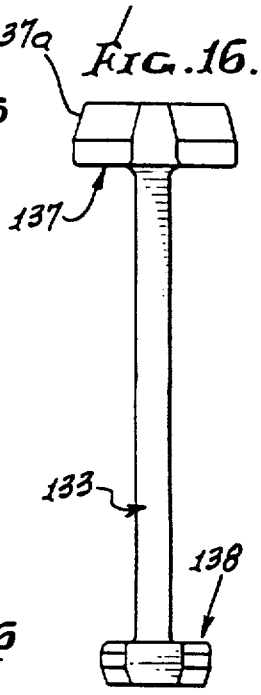

FIG. 3*a* is a fragmentary view showing a packer recess;

FIG. 4 is a view like FIG. 3 showing the packer in partly closed condition;

FIG. 5 is a plan view taken in section on lines 5—5 of FIG. 4;

FIG. 6 is an enlarged side elevation showing an insert as employed in the unit of FIGS. 1-5;

FIG. 7 is an end elevation taken on lines 7—7 of FIG. 6;

FIG. 8 is a bottom plan view taken on lines 8—8 of FIG. 6;

FIG. 9 is an enlarged section taken in elevation on lines 9—9 of FIG. 3;

FIG. 10 is a view like FIG. 9, but taken on lines 10—10 of FIG. 4;

FIG. 11 is a plan view of a modified packer unit, in open condition;

FIG. 12 is an elevation taken in section on lines 12—12 of FIG. 11;

FIG. 13 is a plan view of the packer of FIGS. 11 and 12, but showing it in partly closed condition;

FIG. 14 is an elevation taken in section on lines 14—14 of FIG. 13;

FIG. 15 is an enlarged side elevation showing a modified insert as employed in the unit of FIG. 11-14;

FIG. 16 is an end elevation taken on lines 16—16 of FIG. 15; and

Figure 17:
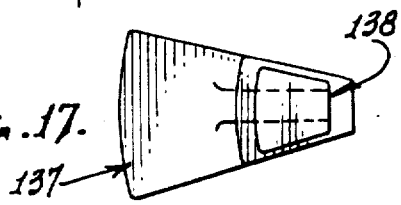

FIG. 17 is a bottom plan view taken on lines 17—17 of FIG. 15.

Figure 18:
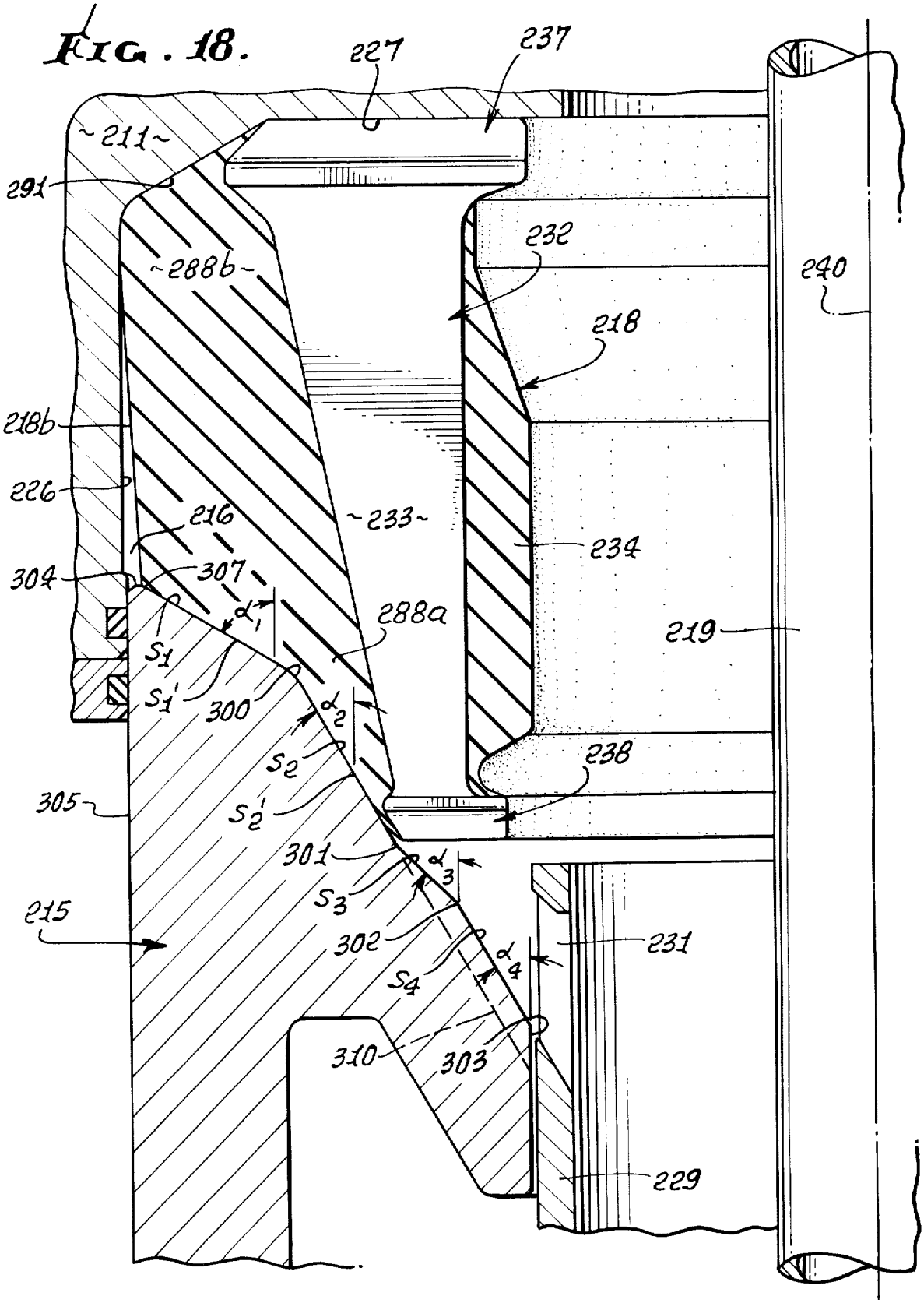
Figure 19:
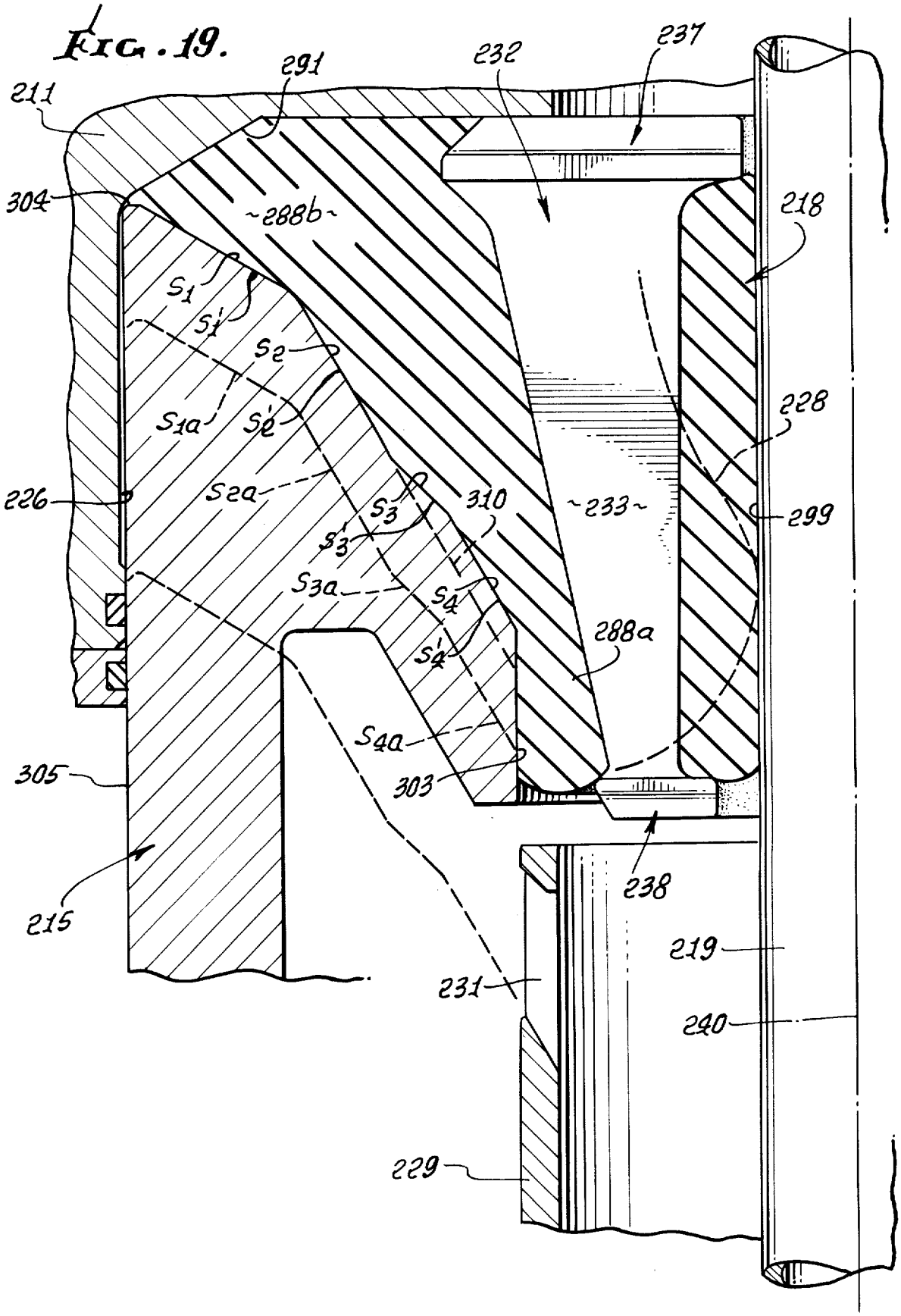

FIG. 18 is a fragmentary side elevation showing a modified packer and piston; and FIG. 19 is a view like FIG. 18 showing the packer and piston in displaced positions.

DETAILED DESCRIPTION

Figure 1:
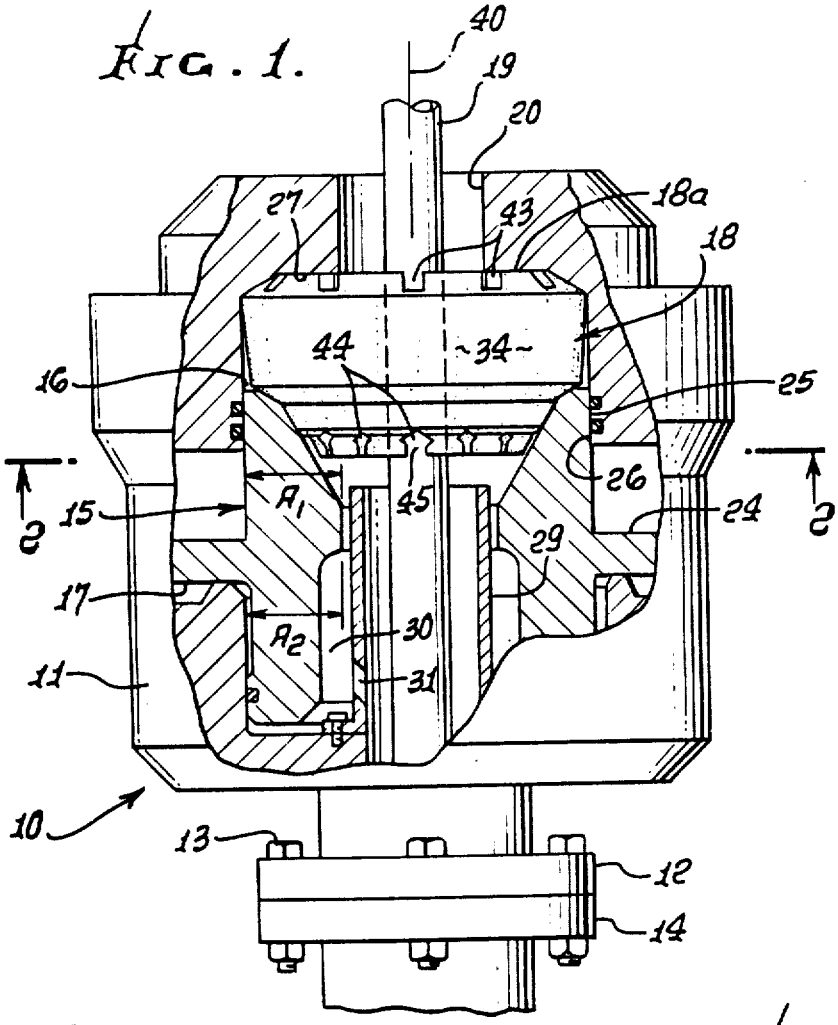
FIG. 1 is an elevation partly in section, showing use of the new packer unit in a blowout preventer assembly.

Referring to FIG. 1, a blowout preventer 10 includes a metallic housing 11, the lowermost extent of which is shown flanged at 12 and bolted at 13 to well head casing flange 14, or other well head equipment. The housing, which may have various configurations, typically contains a piston 15 movable upwardly in chamber 16 in response to fluid pressure exertion upwardly against piston face 17. Such piston movement serves to constrict an annular packer unit 18 via pressure exertion from piston interior cam surface extent against exterior surface extent of the packer.

In accordance with an important aspect of the invention, the annulus has a first body section (as at 88*a*) to be radially inwardly displaced by the piston during its axial advancement (see radial inward bulge 28 in FIG. 4) and a second body section (88*b*) to be axially compressed by the piston during its advancement, so that the second body section compressively engages inner wall surface extent (as at 91 and 91*a*) of the housing during piston advancement. Note that wall 91*a* is frusto-conical, to aid inward feeding of the elastomer at an upper location subsequent to formation of the lower annular bulge 28.

In accordance with another aspect of the invention, the annulus exterior cam surface extent engageable by the piston has angularity which varies in axial radial planes, whereby initial radially inward constriction of successive portions of the packer is enhanced per unit upward displacement of the piston, for faster closing, whereas final inward constriction of successive portions of the packer (as during sealing of the packer about a well pipe) is slowed or reduced to realize a higher mechanical advantage and greater sealing force application, per unit upward displacement of the piston. Note that the piston in FIGS. 3 and 4 "penetrates" the packer, radially outwardly of inserts 32 to be described.

In the example, the packer annulus exterior cam surface extent includes a first frusto-conical portion 23*a* of lesser angularity $\alpha$ relative to the central axis 40 (or lines parallel thereto) and a second frusto-conical portion 23*b* of greater angularity $\beta$ relative to that axis, these being radially outwardly spaced from web surfaces 33*a* and 33*b* to be described. As shown, portions 23*a* and 23*b* intersect at circular region 23*c*, and portion 23*b* is closer to the packer top surface 18*a* than portion 23*a*. Region 23*c* may be concavely curved.

Similarly, the piston 15 has interior cam surface extent engaging the exterior cam surface extent of the packer, and the piston cam surface extent has varying angularity matching that of the annulus cam surface extent, as described, and during upward displacement of the piston. In the example, the piston has a first interior frusto-conical surface portion 15*a* of relatively less angularity $\alpha$ relative to axis 40, in axial radial planes, and engaged with packer surface portion 23*a* and the piston also has a second interior frusto-conical surface portion 15*b* of relatively greater angularity $\beta$ relative to axis 40, and in axial radial planes, and engaged with packer surface portion 23*b*. Typically, angle $\alpha$ may be less than 45°; angle $\beta$ may be greater than 45°; and the difference $\Delta$ between the two angles $\alpha$ and $\beta$ can be in excess of 15°. Other angles are possible.

Surfaces 15*a*, 15*b*, 23*a* and 23*b* are flared upwardly, as shown.

FIG. 4 shows the progressive inward displacement of the packer elastomeric material during piston upward movement, lower annular bulge being first created at 28, inward bulging then progressing upwardly as the piston moves upwardly. The packer, when sufficiently radially inwardly displaced, seals off about a well pipe 19 shown extending axially vertically through the preventer 10. Since the closing of the packer is from the bottom upwardly, the pressure gradient against the pipe is greatest at the bottom and lowest at the top of the packer extent engaging the pipe, which is consistent with the occurrence of highest well fluid pressure at the underside of the packer, and no well pressure at the top of the packer. In the absence of the pipe, the packer unit 18 will completely close off the vertical passage 20 through the preventer, when the unit is sufficiently constricted by the piston 15. Note in FIG. 4 that the second body section 88*b* has greater overall radial dimension "R" in piston advanced position than in piston retracted position (see FIG. 3).

Figure 2:
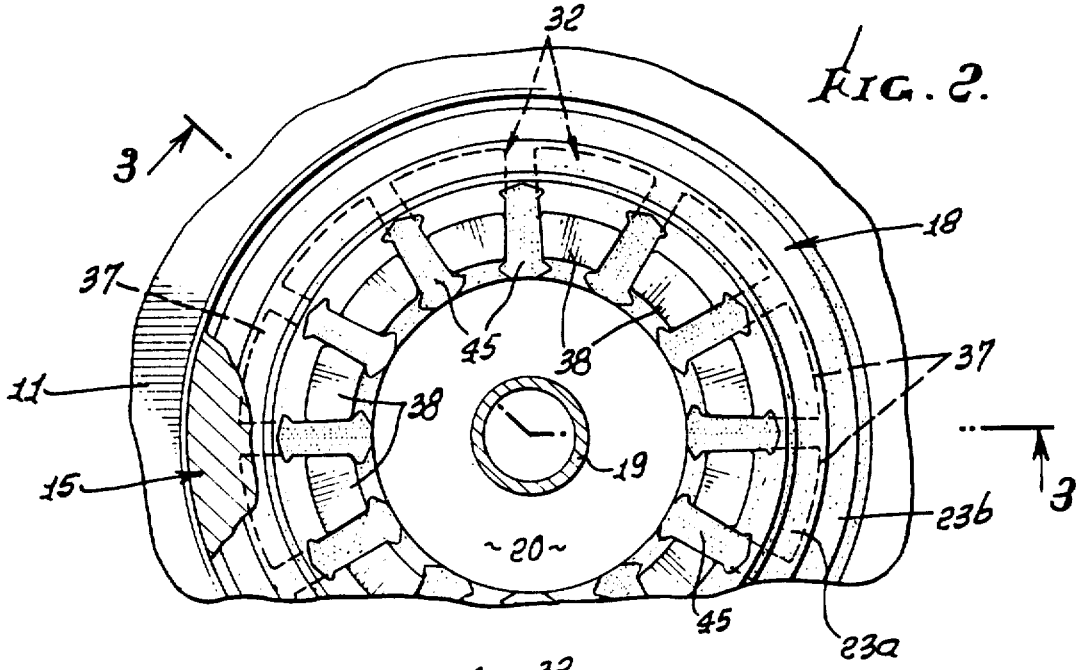
FIG. 2 is an enlarged horizontal section, taken on lines 2—2 of FIG. 1.

Upon downward movement of the piston in response to fluid pressure exertion against face 24, the packer expands radially outwardly to open position as seen in FIGS. 1 and 2. Note that the piston annular surface 25 may have guided sliding engagement with housing cap bore 26, and that the packer unit is normally confined vertically beneath the housing cap lower interior surface 27.

The above functions are further enhanced by making the slant height lengths of cam surfaces 15*a* and 23*a* substantially greater than the slant height lengths of cam surfaces 15*b* and 23*b*.

FIG. 1 also shows that the overall horizontal, annular, upwardly projected cross-sectional area $A_1$ of the piston is approximately equal to the overall horizontal, downwardly projective cross-sectional area $A_2$ exposed to well fluid pressure. This assures a pressure balanced condition at the piston and packer, prior to packer constriction. Note that well fluid pressure gains access to the space 30 at the underside of the piston, via openings 31 in tubular stem 29.

The packer unit 18 includes metallic inserts, as at 32, generally circularly spaced about the center vertical axis 40, the inserts having webs 33 that extend generally longitudinally vertically; also the unit includes annulus 34 of elastomeric material extending about axis 40 and embedding the webs, so that they anchor the elastomeric material during inward compressive displacement of the packer unit. Typically, the rubber is bonded to the metallic inserts. The elastomeric material may consist for example of natural or synthetic rubber. The radial thickness of the elastomer material at 34*a* between the vertical inner edges 33*a* of the webs and the packer bore 36 is less than the radial thickness of the material at 34*c* between the vertical outer edges 33*b* of the webs and the outer periphery 18*b* of the packer annulus. Note that the upper extents 33*c* of the webs 33 have inner surfaces or edges 33*d* facing radially inwardly toward axis 40. Those inner edges or surfaces extend downwardly and outwardly at an angle $\Delta$ (see FIG. 6) relative to vertical, to resist upward displacement of packer material therebelow, in response to inward displacement of the packer by the piston. FIG. 4 shows this condition, with the packer partly closed, but the elastomeric material bulging inwardly at 28, i.e. at a lower level than the levels of edges or surfaces 33*d*. Packer material 18*e* adjacent the latter may be bonded thereto. Accordingly, upward displacement of packer material by well pressure beneath bulge 28 is resisted, with enhanced effect.

Note that web surfaces 33*d* extend upwardly into proximity with and preferably adjacent the radially innermost extents 37*b* of upper plates 37 integral with the tops of the webs. The inserts also have lower or bottom plates 38 integral with the bottoms of the webs. The plates 37 are circularly spaced about axis 40, as are plates 38. Opposite sides 37*a* of plates 37 are formed to interfit, or nearly interfit, during closing of the packer, as appears in FIGS. 5 and 10; however, thin bands 41 of elastomer may be bonded to each such side, as in FIG. 9, to be squeezed as the adjacent plates approach interfit condition. Similarly, opposite sides 38*a* of the lower plates are formed to interfit, or nearly interfit, during closing of the packer, but prior to complete closure. Sides 37*a* taper inwardly toward axis 40, as to sides 38*a*. Also, sides 37*a* taper upwardly, as seen in FIGS. 7–10; and sides 38*a* taper downwardly, such taper angularity $\psi$ from vertical being less than about 10°. Lower portions 37*a'* of sides 37*a* most closely approach one another during closure, and upper portions 38*a'* of sides 38*a* most closely approach one another during closure, thereby sealing off associated recesses 42 from slots 43, and recesses 44 from slots 45. The squeezing of rubber layers or bands 41 (see FIG. 10) also closes slots 43 and seals off recesses 42.

In accordance with another important aspect of the invention, the annulus 18 contains recesses spaced about axis 40 and extending generally radially outwardly from intersections with the annulus bore, such recesses adapted to be constricted in response to inward displacement of the packer unit, to aid anchoring of the packer material against extrusion upwardly past the packer unit upper surface 18*a*, i.e. into region 46 in FIG. 3. In the example, recesses 42 are formed in the packer elastomeric material to extend from intersections 42*a* with the packer bore 36 to intersections 42*b* with the packer exterior. The recesses 42 have polygonal cross sections in planes normal to their generally radial directional extents, as is clear from FIG. 9. Such polygons may be generally diamond shaped, with downwardly converging recess walls 42*c* and 42*d*. During inward displacement of the packer, walls 42*c* and 42*d* are upwardly displaced by flow of excess elastomeric material to collapse such recesses, as is clear from FIG. 10. See also upward rubber flow arrows 47 in FIG. 3. Slots 43 communicating between the tops of the recesses and the top surface of the packer are also collapsed, as described above, sealing off the recesses to prevent upward extrusion of packer material from the recesses, whereby the further flow of packer material is thereby directed radially inwardly to seal off against the well pipe 19 at the general level of the recesses, and during final closure of the packer. Note enlarged mouths 42*e* of recesses 42, in FIG. 3, to aid rubber flow as described.

Similarly, the lower recesses 44 are collapsed downwardly toward slots 45 as rubber flows into such recesses 44 during inward constriction of the packer.

It will be noted that the set of recesses 42 is axially spaced from the set of recesses 43 and is also axially spaced from the first and second frusto-conical surface portions 23*a* and 23*b* of the packer, but closer to surface portion 23*b* than to surface portion 23*a*. Also, each recess 42 and slot 43 combination has "keyhole" configuration, as does each recess 44 and slot 45 combination.

The illustrated packer may contain additional recesses 50 spaced about axis 40 and extending generally radially outwardly from intersections 50*a* with the annulus bore. Recesses 50 may be located at a level or levels intermediate the levels of the two sets of recesses 42 and 44, and are adapted to fill with excess packer elastomeric material during inward constriction of the packer, thereby assisting in confining the initial bulge formation to a relatively lower level, as is clear from FIG. 4. Compare the full size of recess 50 in FIG. 3, with its reduced size 50' in FIG. 4. The number of recesses 50 may equal the number of recesses 42, and they may have generally circular cross sections in planes normal to their radial length directions.

The packer unit 118 shown in FIGS. 11–14 is generally the same as that in FIGS. 1–5, excepting for the inserts 132. The latter have webs 133 with vertical inner sides or edges 133*a* everywhere between upper and lower plates 137 and 138. The upper plates 137 have radially inward extents 137*e* which overhang the webs, in radially inward directions. The annulus 134 of elastomeric material extends at 134*e* inwardly of the innersides 133*a* of the webs, and upwardly toward the overhanging extents of the upper plates, to flare at 134*f* generally toward the intersections 133*d* of the web innersides and the upper plate undersides. As a result, upward extrusion of elastomeric material into bore region 146 is prevented due to retention of that material below the upper plate overhanging extents 137*e*, as assisted by the flow of excess material into the collapsing recesses.

In FIGS. 11–17, the identifying numbers applied to corresponding components are the same as in FIGS. 1–10, excepting for the addition of a hundreds digit to each such number.

In summary, the tall, tapered piston provides a stable and uncomplicated mechanism to provide variable mechanical advantage to variably squeeze the packing element. As hydraulic pressure is applied to the closing chamber of the blowout preventer, the piston is displaced vertically which in turn compresses the rubber reservoir at the back or outer portion of the packing element. As the rubber at the back of the element is being compressed longitudinally, the inserts are driven radially by the compressing rubber toward the center until the top plates of the inserts come together, and the bottom plates of the inserts come together, at which point the inserts lock-up and cease to move further inward, radially. Radial inward displacement of the inserts and of the back rubber reservoir in turn displace the front or inner rubber reservoir of the packing element inward. Closing movement of the inserts acts to displace the rubber between the inserts radially inwardly to feed the front (inner) rubber reservoir. After the inserts lock-up, the lesser taper 15*a* on the piston acts on the back (outer) reservoir of the packing element to feed the rubber between the inserts to the front or inner side of the packing element.

The rubber at the back of the packing element is contained at all times by the top contour of the piston and by the contour of the underside of the head. Since the back (outer side) of the packing element is always contained and always in compression, rubber breakages are prevented. The relative placement of the inserts in relation to the cross-section of the packing element and the cam surfaces of the piston and packer enable the inserts to move quickly radially inwardly in respect to the rubber to reach the predetermined lock-up diameter. This lock-up diameter is at a minimum to minimize the extrusion gap between the plates of the inserts and the pipe to be sealed off. The smaller extrusion gap enhances packing element longevity.

The keyhole-like configurations of the recesses between the flanges of the inserts, prevent rubber from migrating up between and being pinched between the plates as the inserts move radially prior to lock-up. Thus, the keyhole reliefs allow the insert plates to come together to form a continuous metal barrier. Only the annulus area between the insert plates and the pipe remaining for entry of rubber, under well pressure.

The inserts are configured so that shearing stresses and stress risers are minimized. The top front contour of the web provides a bond restraint against vertical rubber displacement. The gradual frontal transition of the web to the insert top plate eliminates well pressure induced rubber breakages. Elimination of back breakage problem allows for greater freedom in insert design. The insert web can be narrowed to provide lower compression stresses. Maximum front elastomer fiber lengths are located at the bottom portion of the insert. The insert bottom frontal web is vertically straight which allows for equal rubber fiber elongation in front of the insert. This configuration allows the packing element to pack-off at a low level in respect to the packing element height. Low pack-off, together with the bond restraint of the web front transition contour, minimizes vertical rubber displacement under well pressure.

The described additional, intermediate recesses help reduce rubber stresses by reducing the shape factor during compression. Such recesses essentially divide the packing element into two packing elements in series, but confined into one unit. An annular groove may be substituted for, or added to, such recesses, as appears at 250 in FIG. 3*a*.

Since the back of the packing element is fully contained, the compressed rubber reacts against the action of the piston. Since the rubber reacted hydraulic area of the piston is essentially equal to the hydraulic area of the piston underneath exposed to well fluid pressure, the packing element and the blowout preventer operations are completely independent of hydrostatic forces causes by water depths and/or drilling fluid weights in subsea operations. Thus, the packing element and the blowout preventer are suitable for both onshore and offshore applications.

In FIG. 18 the annular blowout preventer packing unit 218 is adapted to be compressed during axial movement of piston 215 in a bore 226 extending about chamber 216 within housing 211. The packer includes metallic inserts 232 corresponding to inserts 132 in FIG. 14. The former include upper plates 237 spaced about the central longitudinally vertical axis 240 and slidable horizontally in engagement with housing cap lower interior horizontal surface 227. Also, the inserts have webs 233 that extend generally longitudinally, as shown, and connected with lower plates 238. The plates 237 may be formed to have shapes like those of plates 37, so as to interfit (as do plates 238, also) during closing of the packer, but prior to complete closure of the packer elastomeric annulus 234, as against a pipe 219.

The annulus 234 extends about the axis 240 and embeds the webs 233, which are bonded thereto, so that the webs anchor the elastomeric material during radial displacement or constriction thereof under controlled constriction. The annulus has first and second body portions 288*a* and 288*b* corresponding to similar body portions or sections 88*a* and 88*b* in FIG. 4, and displaceable in similar manner.

The piston 215 has at least three, and preferably four, interior frusto-conical cam surfaces engageable with the underside of the first body portion or section 288*a* of the annulus. Those surfaces are indicated at $S_1$, $S_2$, $S_3$ and $S_4$ for example, and sequential of these surfaces have different angularities relative to the axis 240; also sequential of the surfaces are at successively closer spacings from axis 240.

As shown, the following relationships exist:

$S_1$ extends at angle $\alpha_1$ relative to axis 240
$S_2$ extends at angle $\alpha_2$ relative to axis 240
$S_3$ extends at angle $\alpha_3$ relative to axis 240
$S_4$ extends at angle $\alpha_4$ relative to axis 240
Also, $\alpha_1 > \alpha_2 < \alpha_3 > \alpha_4$
Further
$\alpha_1 > 45°$ and is about 60°;$\alpha 3$ is about 45°
$\alpha_2 < 45°$ and is about 30°;$\alpha 4$ is about 30°
$\alpha_2 < \alpha_3 < \alpha_1$
$S_4$ is approximately parallel to $S_2$
$S_1$ intersects $S_2$ at circular line 300
$S_2$ intersects $S_3$ at circular line 301
$S_3$ intersects $S_4$ at circular line 302

$S_4$ intersects the bore 303 of the piston, and $S_1$ intersects, at line 307, a narrow annular ledge 304 on the piston, which in turn intersects exterior cylindrical surface 305 of the piston. In FIG. 18 position of the piston, the outer surface 218*b* of the packer tapers toward circular line 307, and away from the bore 226 of housing 211, whereas the packer upper portion 288*b* engages the housing frusto-conical surface 291. In FIG. 18 the piston is in full down position, and surfaces $S_1$ and $S_2$ support the packer unit, as shown, spaced above the level of tubular stem 229. The latter has openings 231 that direct fluid pressure against the underside of the packer and piston, as shown in FIG. 19.

Note in FIG. 18 that the packer has angled exterior surfaces $S_1'$ and $S_2'$ corresponding to piston surfaces $S_1$ and $S_2$, respectively, and in engagement therewith. Also, as surfaces $S_1$ and $S_2$ move up, they penetrate the packer elastomeric (as for example rubber) material, causing that material to continue to fill the chamber between the inserts 233, housing surfaces 226 and 291, and piston surfaces $S_1$ and $S_2$.

As surfaces $S_3$ and $S_4$ move up, they too, penetrate the lower extent 288*a* of the packer, as is clear from FIG. 19, urging the packer material radially inwardly toward the surface of the pipe to be sealed off, as at 299. In this regard, the elastomeric material initially bulges inwardly, as shown by broken line 228 in FIG. 19, and corresponding to bulge 28 in FIG. 4; thereafter, as the piston continues to move upwardly, the piston surfaces $S_3$ and $S_4$ penetrate the packer, and until the seal is fully established against the pipe, as in FIG. 19, with maximum compression.

Note that surfaces $S_3$ and $S_4$ are located above the broken line 310, which is a continuation of surface $S_2$, the volume represented between line 310 and surface $S_3$ and $S_4$ corresponding to the additional packer material that is displaced toward the seal zone, to enhance or optimize the sealing pressure near the lower end of the packer. The full "up" position of the piston is shown by the full lines $S_1$–$S_4$ in FIG. 19, whereas the broken lines $S_{1a}$, $S_{2a}$, $S_{3a}$ and $S_{4a}$ indicate the piston intermediate position at the time the inserts "lock-up" i.e. their radial inward displacement ceases due to interfit of upper plates 237. As the piston travels upwardly beyond intermediate position, the elastomer material is displaced inwardly through the spaces between webs 233. Plates 238 also interfit, when plates 237 interfit.

It is found that wear degradation of the packer, particularly at its outer surface, is minimized due to the above described construction, whereby the life of the packer is materially enhanced.

In FIGS. 18 and 19, packer surfaces $S_1'$, $S_2'$, $S_3'$ and $S_4'$ correspond to piston surfaces $S_1$, $S_2$, $S_3$ and $S_4$.

We claim:

1. In an annular blowout preventer packer unit having a longitudinal axis, the packer unit adapted to be compressed during axial advancement of a piston in a housing, and to engage surface extent of the housing facing inwardly toward said axis, the combination comprising (a) said packer unit including metallic inserts generally circularly spaced about said axis, the inserts having webs that extend generally longitudinally, and (b) said unit including an annulus of elastomeric material extending about said axis and embedding said webs so that the webs anchor the material during displacement thereof, the annulus having a bore, (c) the annulus having a first body section located to be radially inwardly displaced by the piston during its axial advancement, and a second body section located to be axially compressed by the piston during its advancement so that the second body section remains compressively engaged against said inner surface extent of the housing during said piston advancement, said first and second body sections being integral and in longitudinal alignment prior to said compression of the packer unit by the piston, (d) said first body section having a first frusto-conical portion of lesser angularity relative to said axis and a second frusto-conical portion of greater angularity relative to said axis, said second portion having greater radial spacing from said axis than said first portion, said portions located radially outwardly of the webs, (e) the preventer including said piston having at least three interior frusto-conical cam surfaces engageable with said first body section, sequential of said surfaces having different angularites relative to said axis, and sequential of said surfaces being at successively closer spacings from said axis.

2. The combination of claim 1 wherein there are four of said surfaces, $S_1$, $S_2$, $S_3$ and $S_4$.

3. The combination of claim 2 wherein said surfaces $S_1$, $S_2$, $S_3$ and $S_4$ respectively define angles $\alpha_1$, $\alpha_2$, $\alpha_3$ and $\alpha_4$ relative to said axis, and wherein $\alpha_1 > \alpha_2$ $\alpha_2 < \alpha_3$ and $\alpha_3 > \alpha_4$

4. The combination of claim 3 wherein $\alpha_1 > 45°$.

5. The combination of claim 4 wherein $\alpha_2 < 45°$.

6. The combination of claim 5 wherein $\alpha_2 < \alpha_3 < \alpha_1$.

7. The combination of claim 6 wherein $S_4$ is approximately parallel to $S_2$.

8. The combination of claim 2 wherein $S_1$ intersects $S_2$, $S_2$ intersects $S_3$, and $S_3$ intersects $S_4$.

9. The combination of claim 2 wherein said piston has an initial position wherein at least one of $S_3$ and $S_4$ axially and openly faces ends of the inserts.

10. In an annular blowout preventer including a packer unit having a longitudinal axis, the packer unit adapted to be compressed during axial advancement of a piston in a housing, the combination comprising (a) said packer unit including metallic inserts generally circularly spaced about said axis, the inserts having webs that extend generally longitudinally, and (b) said unit including an annulus of elastomeric material extending about said axis and embedding said webs so that the webs anchor the material during displacement thereof, the annulus having a bore, (c) the annulus having a first body section to be radially inwardly displaced by the piston during its axial advancement, and a second body section to be axially compressed by the piston during its advancement so that the second body section compressively engages inner surface extent of the housing, said first and second body sections being integral and in longitudinal alignment prior to said compression of the packer unit by the piston, (d) the preventer including said piston having four interior frusto-conical cam surfaces $S_1$, $S_2$, $S_3$ and $S_4$ engageable with said first body section, sequential of said surfaces having different angularities relative to said axis, and sequential of said surfaces being at successively closer spacings from said axis, (e) said piston having an initial position wherein both $S_3$ and $S_4$ axially and openly face ends of the inserts.

11. The combination of claim 9 wherein $S_1$ and $S_2$ are radially outwardly spaced from the inserts and said elastomeric material substantially fills the space between $S_1$ and $S_2$ and said inserts.

12. The combination of claim 9 wherein said piston has a first axially displaced position in which all of $S_1$, $S_2$, $S_3$ and $S_4$ are radially outwardly spaced from said inserts, said inserts are displaced radially inwardly to lock-up positions in which the inserts are blocked against further radially inward displacement, and said elastomeric material between the inserts and $S_1$, $S_2$, $S_3$ and $S_4$ is in a first state of compression.

13. The combination of claim 12 wherein said piston has a second axially displaced position wherein all of $S_1$, $S_2$, $S_3$ and $S_4$ are radially outwardly spaced from said inserts but are closer to the upper ends of the inserts than in said first axially displaced position, and said elastomeric material between the inserts and $S_1$, $S_2$, $S_3$ and $S_4$ is in a second state of compression.

14. The combination of claim 13 wherein the elastomer material in said second state of compression is at higher compression than in said first state of compression.

15. The combination of claim 13 including housing structure confining the compressed elastomer material axially of $S_1$, $S_2$ and $S_3$, in said second axially displaced position of the piston.

16. The unit of claim 1 wherein said packer has upper and lower surfaces and said axis extends generally vertically, the inserts including upper plates and lower plates and upwardly extending webs interconnecting said upper and lower plates, the upper plates overhanging the webs in radially inward directions, the annulus of elastomeric material extending at the radially inward sides of the webs and upwardly toward said overhanging upper plates, and flaring generally toward the intersections of the web inner sides and the upper plates.

17. In an annular blowout preventer packer unit having a longitudinal axis, the packer unit adapted to be compressed during axial advancement of a piston in a housing, and to engage surface extent of the housing facing inwardly toward said axis, the combination comprising (a) metallic inserts generally circularly spaced about said axis, the inserts having webs that extend generally longitudinally, and (b) an annulus of elastomeric material extending about said axis and embedding said webs so that the webs anchor the material during displacement thereof, the annulus having a bore, (c) the annulus having a first body section located to be radially inwardly displaced by the piston during its axial advancement, and a second body section located to be axially compressed by the piston during its advancement so that the second body section remains compressively engaged against said inner surface extent of the housing during said piston advancement, said first and second body sections being integral and in longitudinal alignment prior to said compression of the packer unit by the piston, (d) said first body section having a first frusto-conical portion of lesser angularity relative to said axis and a second frusto-conical portion of greater angularity relative to said axis, said second portion having greater radial spacing from said axis than said first portion, said portions located radially outwardly of the webs, (e) the packer unit first body section having at least three exterior frusto-conical cam surfaces respectively engageable by at least three interior frusto-conical cam surfaces defined by the piston, sequential of said exterior surfaces having different angularities relative to said axis, and sequential of said exterior surfaces being at successively closer spacings from said axis.

18. The combination of claim 17 wherein there are four of said packer cam surfaces, $S_1'$, $S_2'$, $S_3'$ and $S_4'$, which are defined during said displacement of the packer by the piston.

19. The combination of claim 17 wherein said surfaces $S_1'$, $S_2'$, $S_3'$ and $S_4'$ respectively define angles $\alpha_1$, $\alpha_2$, $\alpha_3$ and $\alpha_4$ relative to said axis, and wherein $\alpha_1 > \alpha_2$ $\alpha_2 < \alpha_3$ and $\alpha_3 > \alpha_4$

20. The combination of claim 19 wherein $\alpha_1 > 45°$.

21. The combination of claim 20 wherein $\alpha_2 < 45°$.

22. The combination of claim 21 wherein $\alpha_2 < \alpha_3 < \alpha_1$.

23. The combination of claim 22 wherein $\alpha_4$ is approximately equal to $\alpha_2$.

24. The combination of claim 18 wherein $S_1$ intersects $S_2$, $S_2$ intersects $S_3$, and $S_3$ intersects $S_4$.

25. The unit of claim 17 wherein said packer has upper and lower surfaces and said axis extends generally vertically, the inserts including upper plates and lower plates and upwardly extending webs interconnecting said upper and lower plates, the upper plates overhanging the webs in radially inward directions, the annulus of elastomeric material extending at the radially inward sides of the webs and upwardly toward said overhanging upper plates, and flaring generally toward the intersections of the web inner sides and the upper plates.

26. In an annular blowout preventer including a packer unit having a longitudinal axis, the packer unit adapted to be compressed during axial displacement of a piston in a housing, the combination comprising (a) said packer unit including metallic inserts generally circularly spaced about said axis, the inserts having webs that extend generally longitudinally, and (b) said unit including an annulus of elastomeric material extending about said axis and embedding said webs so that the webs anchor the material during displacement thereof, the annulus having a bore, (c) the annulus adapted to be axially penetrated by the piston during its axial advancement, so that elastomeric material flows radially inwardly toward said axis, (d) the preventer including said piston having four interior frusto-conical surfaces $S_1$, $S_2$, $S_3$ and $S_4$ engageable with the annulus during piston penetration thereof, sequential of said surfaces having different angularities relative to said axis and sequential of said surfaces being at successively closer spacings from said axis, at least two of said surfaces $S_1$, $S_2$, $S_3$ and $S_4$ openly facing ends of the inserts.

27. The combination of claim 26 wherein said surfaces $S_1$, $S_2$, $S_3$ and $S_4$ respectively define angles $\alpha_1$, $\alpha_2$, $\alpha_3$, and $\alpha_4$ relative to said axis, and wherein $\alpha_1 > \alpha_2$ $\alpha_2 < \alpha_3$ and $\alpha_3 > \alpha_4$

28. The combination of claim 27 wherein $S_1$ intersects $S_2$, $S_2$ intersects $S_3$, and $S_3$ intersects $S_4$.

29. The combination of claim 26 wherein said piston has an initial position wherein at least one of $S_3$ and $S_4$ axially and openly faces ends of the inserts.

30. In an annular blowout preventer including a packer unit having a longitudinal axis, the packer unit adapted to be compressed during axial displacement of a piston in a housing, the combination comprising (a) said packer unit including metallic inserts generally circularly spaced about said axis, the inserts having webs that extend generally longitudinally, and (b) said unit including an annulus of elastomeric material extending about said axis and embedding said webs so that the webs anchor the material during displacement thereof, the annulus having a bore, (c) the annulus adapted to be axially penetrated by the piston during its axial advancement, so that elastomeric material flows radially inwardly toward said axis, (d) the preventer including said piston having four interior frusto-conical surfaces $S_1$, $S_2$, $S_3$ and $S_4$ engageable with the annulus during piston penetration thereof, sequential of said surfaces having different angularities relative to said axis and sequential of said surfaces being at successively closer spacings from said axis, (e) said piston having an initial position wherein both $S_3$ and $S_4$ axially and openly face ends of the inserts.

* * * * *